US009085389B2

(12) United States Patent
Benson

(10) Patent No.: US 9,085,389 B2
(45) Date of Patent: Jul. 21, 2015

(54) APPARATUS AND METHOD FOR PACKAGING MEAT

(75) Inventor: Dean Benson, Wauwatosa, WI (US)

(73) Assignee: Swaggerty Sausage Co., Inc., Kodak, TN (US)

( * ) Notice: Subject to any disclaimer, the term of this patent is extended or adjusted under 35 U.S.C. 154(b) by 1058 days.

(21) Appl. No.: 13/089,809

(22) Filed: Apr. 19, 2011

(65) Prior Publication Data

US 2012/0266570 A1 Oct. 25, 2012

(51) Int. Cl.

| | |
|---|---|
| ***B65B 7/28*** | (2006.01) |
| ***B65D 21/02*** | (2006.01) |
| ***B65D 43/02*** | (2006.01) |
| ***B65D 51/24*** | (2006.01) |

(52) U.S. Cl.

CPC ..... *B65D 21/0233* (2013.01); *B65D 21/0222* (2013.01); *B65D 43/021* (2013.01); *B65D 51/249* (2013.01); *B65D 21/02* (2013.01); *B65D 2543/0062* (2013.01); *B65D 2543/00101* (2013.01); *B65D 2543/00296* (2013.01); *B65D 2543/00509* (2013.01); *B65D 2543/00685* (2013.01); *B65D 2543/00731* (2013.01); *B65D 2543/00796* (2013.01); *Y10T 29/49815* (2015.01)

(58) Field of Classification Search

CPC .. B65D 21/00; B65D 21/022; B65D 21/0222; B65D 21/0223; B65D 21/0219; B65D 21/0234

USPC ..... 53/449; 220/701, 212, 669, 780, 781, 220/630, 796; 206/508, 45.2, 212, 505

See application file for complete search history.

(56) References Cited

U.S. PATENT DOCUMENTS

| | | | | | |
|---|---|---|---|---|---|
| 3,095,132 | A | * | 6/1963 | Hawley | 229/404 |
| 3,145,870 | A | * | 8/1964 | Lockwood | 220/4.24 |
| 3,659,741 | A | * | 5/1972 | Corelli | 220/592.01 |
| 3,770,115 | A | * | 11/1973 | Cannell | 206/508 |
| 3,779,418 | A | * | 12/1973 | Davis | 220/781 |
| 3,989,142 | A | * | 11/1976 | Gwilliam et al. | 206/508 |
| 4,047,329 | A | * | 9/1977 | Holt | 47/65.7 |
| 4,051,951 | A | * | 10/1977 | Smith | 206/508 |
| 4,113,095 | A | * | 9/1978 | Dietz et al. | 206/508 |
| 4,421,244 | A | * | 12/1983 | Van Melle | 220/781 |
| 4,531,669 | A | | 7/1985 | Osborne | |
| 4,756,421 | A | | 7/1988 | Meek | |
| 4,756,917 | A | * | 7/1988 | Kamada et al. | 428/457 |
| 4,826,039 | A | * | 5/1989 | Landis | 220/380 |
| 4,911,772 | A | * | 3/1990 | Hoffmann | 156/86 |
| 4,949,527 | A | | 8/1990 | Boeckmann et al. | |
| 4,962,849 | A | | 10/1990 | Anderson | |
| 5,011,006 | A | | 4/1991 | Anderson | |
| 5,312,011 | A | * | 5/1994 | Fischer | 220/528 |
| 5,332,114 | A | * | 7/1994 | Sano et al. | 220/4.24 |
| 5,514,392 | A | | 5/1996 | Garwood | |
| 5,534,282 | A | | 7/1996 | Garwood | |
| 5,586,656 | A | * | 12/1996 | Abrums | 206/501 |
| 5,607,075 | A | * | 3/1997 | Burgdorf et al. | 220/319 |
| 5,629,060 | A | * | 5/1997 | Garwood | 428/35.2 |
| 5,634,559 | A | * | 6/1997 | Foos et al. | 206/518 |

(Continued)

*Primary Examiner* — Hemant M Desai
*Assistant Examiner* — Eduardo R Ferrero
(74) *Attorney, Agent, or Firm* — Boyle Fredrickson, S.C.

(57) ABSTRACT

Disclosed is a package having a rigid tray and a dual purpose portion that can serve either as a base for the tray or a lid for the tray. The dual purpose portion has a first grooved portion sized to be retained by a base portion of the tray, and a second grooved portion sized to be retained by an upper lip portion of the tray.

11 Claims, 5 Drawing Sheets

(56) References Cited

U.S. PATENT DOCUMENTS

| | | | | |
|---|---|---|---|---|
| 5,769,229 | A * | 6/1998 | Andress et al. | 206/505 |
| 5,799,792 | A * | 9/1998 | Abrums | 206/508 |
| 5,842,675 | A * | 12/1998 | Davitt | 248/346.5 |
| 5,888,565 | A | 3/1999 | Gics | |
| 6,085,930 | A | 7/2000 | Curtis | |
| 6,158,607 | A * | 12/2000 | Wallberg | 220/212 |
| 6,273,291 | B1 * | 8/2001 | Conti | 220/781 |
| 6,419,112 | B1 * | 7/2002 | Bruce et al. | 220/781 |
| 6,491,185 | B1 * | 12/2002 | Azzarello et al. | 220/783 |
| 6,651,874 | B1 * | 11/2003 | Pedersen | 229/123.1 |
| 6,796,430 | B2 * | 9/2004 | Mercier et al. | 206/505 |
| 6,858,288 | B2 * | 2/2005 | Shibata et al. | 428/213 |
| 6,883,678 | B2 * | 4/2005 | Chou | 220/793 |
| 6,886,694 | B2 * | 5/2005 | McNeeley et al. | 206/505 |
| 6,983,575 | B2 | 1/2006 | Longo | |
| 7,011,215 | B2 * | 3/2006 | Meissen et al. | 206/557 |
| 7,017,773 | B2 * | 3/2006 | Gruber et al. | 220/675 |
| 7,163,122 | B2 * | 1/2007 | Elder et al. | 220/669 |
| 7,261,219 | B2 * | 8/2007 | Tucker et al. | 220/793 |
| 7,392,905 | B2 * | 7/2008 | Andersen et al. | 206/427 |
| 7,468,498 | B2 | 12/2008 | Tuszkiewicz et al. | |
| 7,475,780 | B2 | 1/2009 | Hinze et al. | |
| 7,726,483 | B2 * | 6/2010 | Ramanujam et al. | 206/508 |
| 7,731,997 | B2 | 6/2010 | Castellanos et al. | |
| 2003/0057207 | A1 * | 3/2003 | Wong | 220/4.24 |
| 2003/0111468 | A1 * | 6/2003 | Kao | 220/212 |
| 2003/0155267 | A1 * | 8/2003 | Mercier et al. | 206/515 |
| 2003/0155363 | A1 * | 8/2003 | Mercier | 220/630 |
| 2003/0185937 | A1 * | 10/2003 | Garwood | 426/35 |
| 2004/0016761 | A1 * | 1/2004 | Wilde et al. | 220/630 |
| 2004/0035867 | A1 * | 2/2004 | Schultz et al. | 220/212 |
| 2004/0040961 | A1 * | 3/2004 | Vilalta et al. | 220/212 |
| 2005/0199639 | A1 * | 9/2005 | Tucker et al. | 220/780 |
| 2006/0186014 | A1 * | 8/2006 | Ramanujam et al. | 206/508 |
| 2006/0261065 | A1 * | 11/2006 | Claypool et al. | 220/212 |
| 2007/0187277 | A1 * | 8/2007 | Furlong | 206/515 |
| 2007/0295631 | A1 * | 12/2007 | Lin et al. | 206/508 |
| 2008/0128313 | A1 * | 6/2008 | Anderson et al. | 206/565 |
| 2009/0173656 | A1 * | 7/2009 | Furlong | 206/508 |
| 2009/0200324 | A1 * | 8/2009 | Geelen | 220/780 |
| 2012/0266570 | A1 * | 10/2012 | Benson | 53/471 |

* cited by examiner

APPARATUS AND METHOD FOR PACKAGING MEAT

BACKGROUND OF THE INVENTION

1. Field of the Invention

The present invention relates to tray for containing sausages, and more particularly, relates to a tray that provides advantages in the packaging, marketing, and storage of fresh sausages.

2. Discussion of the Related Art

In the field of packaging fresh meats, "case ready" packages are those that arrive at the grocery store ready to be put into a refrigerator display case, in contrast to meat that requires further butchering or packaging. Case ready packages are typically composed of a foam or plastic tray with a plastic film covering. The interior atmosphere of the tray is often modified with a gas flush to limit oxygen and thus extend shelf life.

In recent years, the grocery industry has increasingly turned to case ready packaging. This is especially true in the "superstore" sector, in which a full line of groceries is provided in a store along with sporting goods, clothing, housewares, electronics, etc. In many of these superstores, a customer is encouraged to buy a larger volume of product in order to obtain a cost benefit.

Meat has become concomitantly commoditized, with an emphasis on identical weights and cuts of meat across all packages, and the importance of the packaging itself has increased considerably. As such, it is important to provide a package that not only keeps meat fresh and fresh-looking, but also one that appeals to the consumer. Further, from the point of view of the meat packager, it is important to use a package that can be stored and shipped compactly when empty, that can be filled and sealed easily, and when filled, appeals to the superstore's desire to display items flexibly but attractively.

It should be noted that the relevant consumers are often value-minded, and may purchase meat in large quantities in order to obtain the best value, but these consumers do not typically have commercial kitchens. The packages must therefore still be sized to fit within standard refrigerator units. In addition, consumers who need larger quantities of meat but are not quite large enough to have a commercial food vendor deliver such items, such as sandwich shops, bar & grill restaurants, etc., also are inclined to purchase case ready meats in superstore settings. The needs of the various consumers call for a case ready package that is easily stored and filled by the meat processor, able to be displayed by a grocer in a number of configurations, and that keeps a larger quantity of meat fresh for long periods of time within the refrigerator of a purchaser.

SUMMARY OF THE INVENTION

The apparatus of the present invention thus includes a package having a rigid tray and a dual purpose portion. The tray has a base portion, wall portions, and an upper lip portion, while the dual purpose portion has a planar surface, a first grooved portion sized to be retained by the base portion of the tray, and a second grooved portion sized to be retained by the upper lip portion of the tray. The base portion includes an offset portion and a floor portion, wherein the offset portion has a perimeter and the first grooved portion of the dual purpose portion is sized to press fit around the perimeter, thus forming a broad base for the package. The second grooved portion is sized to press fit over the upper lip portion of the tray, and when applied in that fashion, the dual purpose portion serves as a lid for storage of the product within.

BRIEF DESCRIPTION OF THE DRAWINGS

Preferred exemplary embodiments of the invention are illustrated in the accompanying drawings, in which like reference numerals represent like parts throughout, and in which.

DETAILED DESCRIPTION OF THE PREFERRED EMBODIMENTS

Figures 1, 2:
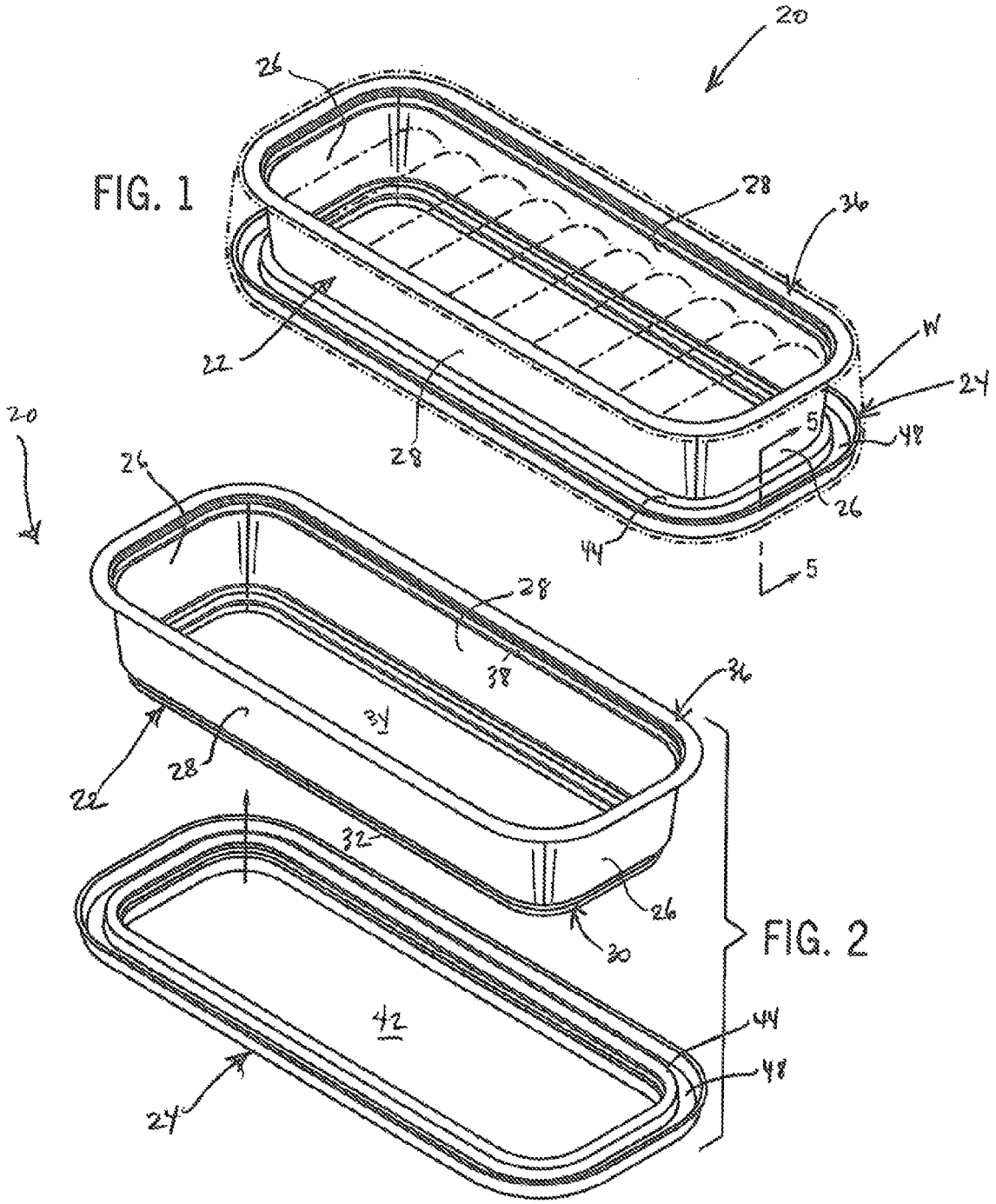
FIG. 1 is a perspective view of a case-ready package of sausages as contemplated in one embodiment of the present invention, with the dual-purpose portion of the package in place on the tray portion of the package as a lid.
FIG. 2 is a perspective view of a tray and dual-purpose portion of the package, showing the two elements separated from one another with the dual-purpose portion in a position to be attached to the bottom of the tray and act as a base.
Figure 3:
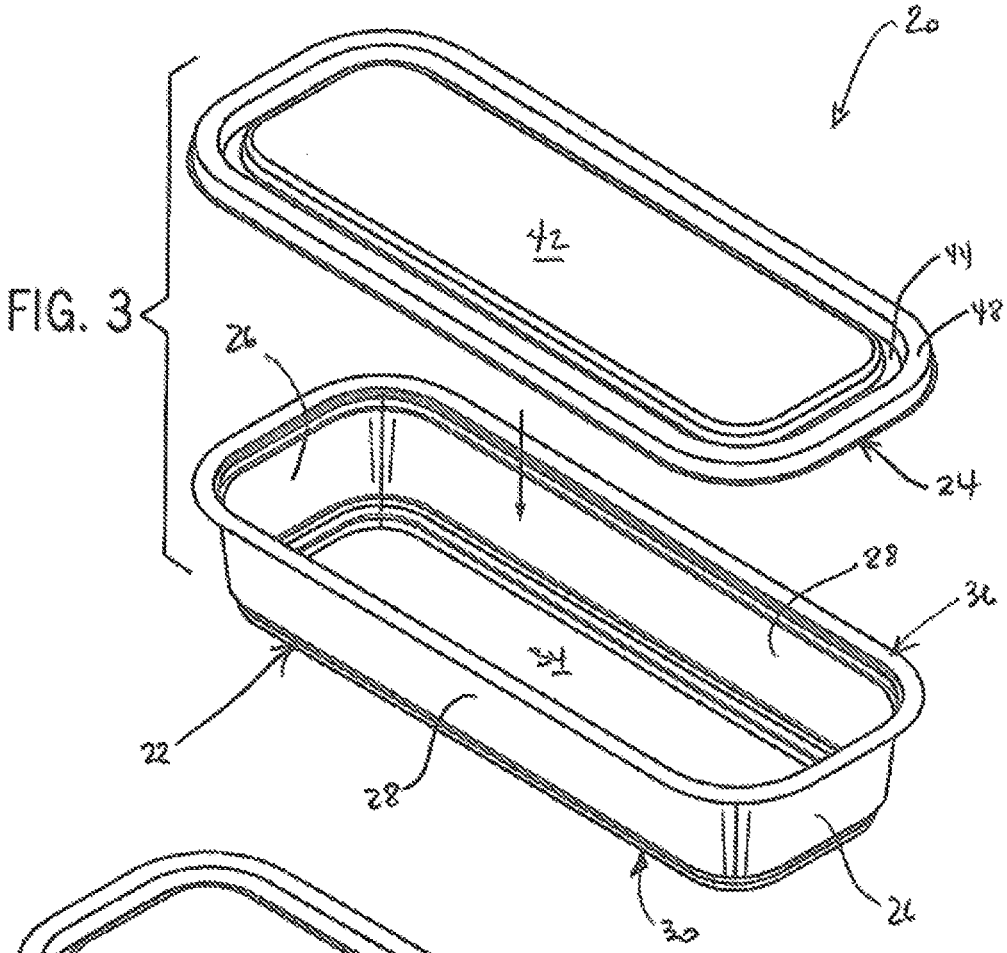
FIG. 3 is a perspective view a tray and dual-purpose portion of the package, showing the two elements separated from one another with the dual-purpose portion in a position to be attached to the top of the tray and act as a lid.
Figure 5:
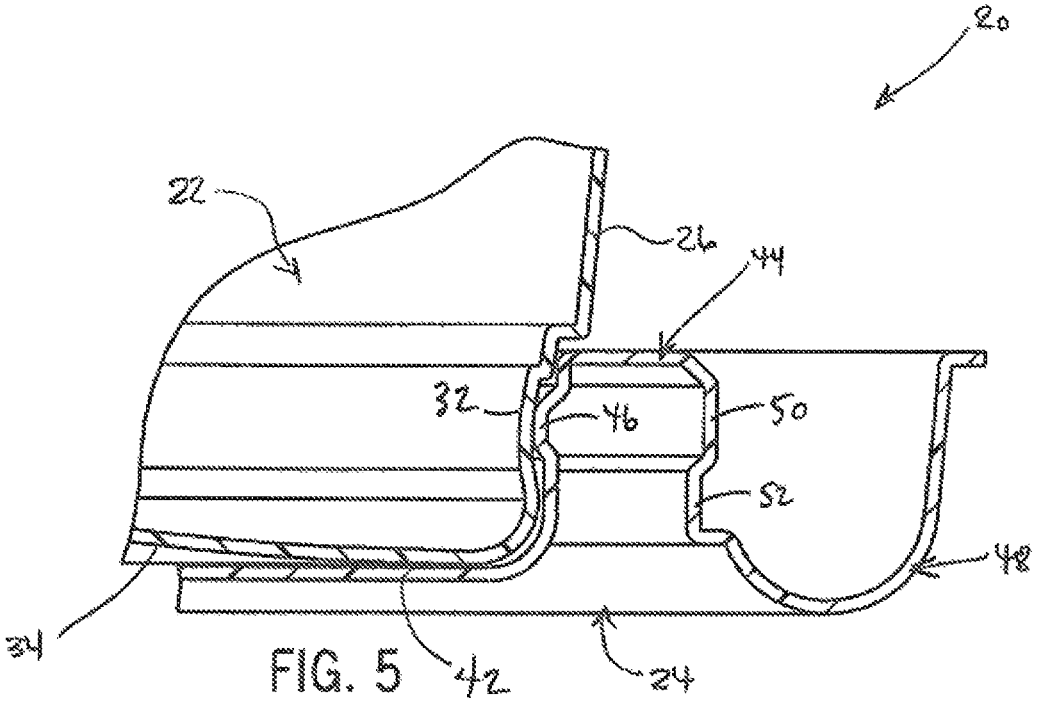
FIG. 5. is a side cutaway view of the package shown in FIG. 1 taken from the perspective indicated by lines 5-5.
Figure 7:
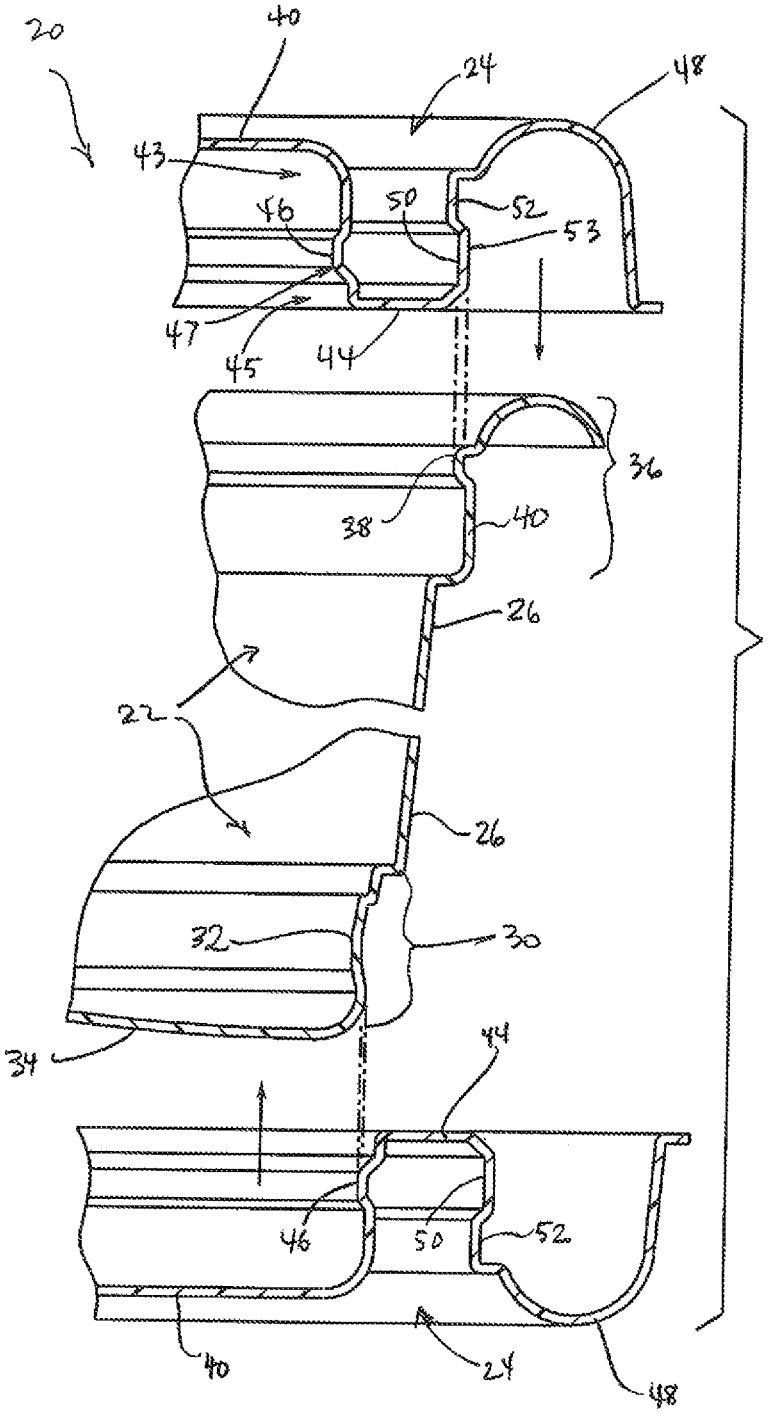
FIG. 7 is a side cutaway view of an embodiment of the package of the present invention showing a dual-purpose portion positioned to be attached to the top of the tray and showing a dual-purpose portion positioned to be attached to the bottom of the tray.

FIG. 1 shows a case-ready package 20 having a plurality of fresh sausages (not numbered) therein. Package 20 has a tray portion 22 and a dual-purpose portion 24. Tray portion 22 comprises a first set of opposing sides 26 and a second set of opposing sides 28 that together form a wall extending about an interior of the tray that receives product while packing at the packaging location. Sides 26 and 28 are sloped so that tray 22 is larger at its opening than at its bottom. As seen in FIGS. 2, 5 and 7, tray 22 has an inset portion 30 at its bottom margin, and inset portion 30 has a lower recess extending inwardly toward the interior of the tray 22, shown as detent 32. At the top end of tray 22, a lip portion 36 bears a ridge 38 and an upper recess extends outwardly from the interior of the tray, shown as projection 40. Referring now to FIG. 7, dual-purpose portion 24 has a planar surface or portion 42, a base segment 43 connected to the planar portion 42, an inner rib 44 extending from the base segment 43 to an outer end or end segment 45 that is wider in cross-section than the base segment 43. End segment 45 has a ridge 46 at an inwardly facing first side portion 47 and an outer rib 48 extending from ridges 50, 52 defined at an outwardly facing second side portion 53 of the inner rib 44.

Figure 4:
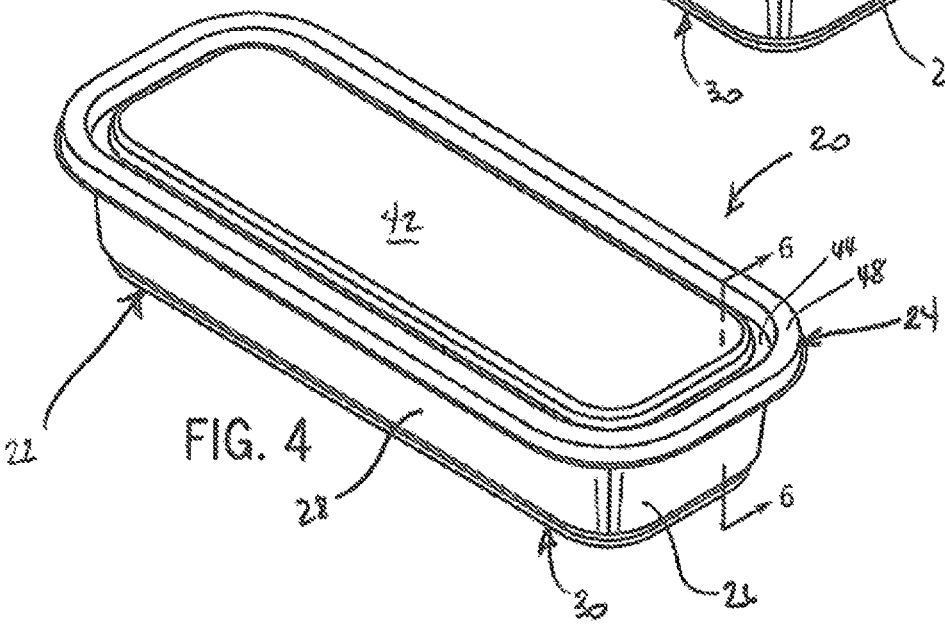
FIG. 4 is a perspective view of a package of the present invention with the dual-purpose portion in place as a lid.
Figure 6:
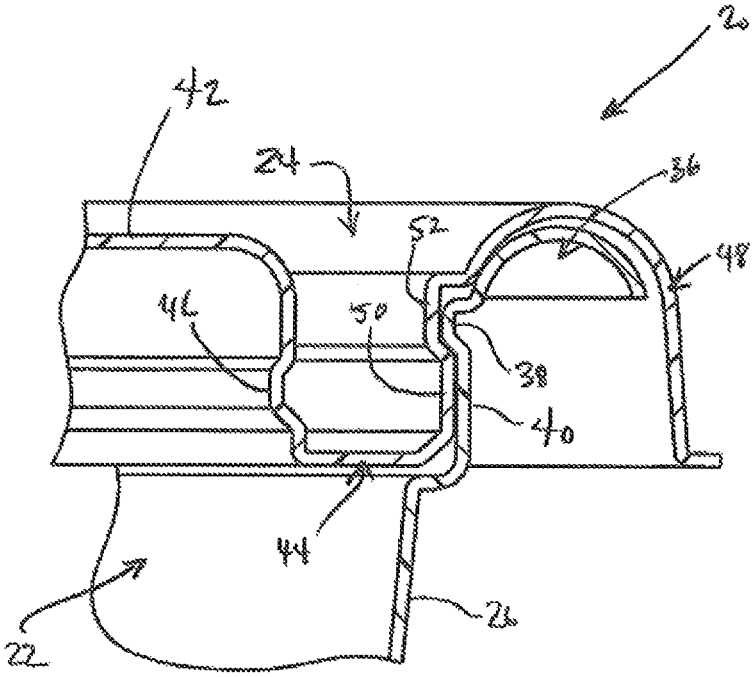
FIG. 6 is a side cutaway view of the package shown in FIG. 3 taken from the perspective indicated by lines 6-6.

Inner rib 44 of dual-purpose portion 24 generally corresponds in shape to inset portion 30 of tray 22. Inner rib 44 thus is able to receive inset portion 30, and the interaction of detent 32 and ridge 46 provides a nesting receipt and engagement of the inwardly facing side portion 47 (FIG. 7) of the inner rib 44 into the inwardly extending lower recess of detent 32 of the tray 22, as shown in FIG. 5. This allows dual-purpose portion 24 to be releasably retained on inset portion 30 when the dual-purpose portion 24 acts as a base for package 20, such that the dual-purpose portion 24 defines a package base position, as shown best in FIGS. 1 and 5. Dual-purpose portion 24 can also be inverted (FIG. 7) to act as a lid for package 20 when the dual-purpose portion 24 defines a package lid position, as shown best in FIGS. 4 and 6, with outer rib 48 being constructed to generally correspond in shape to lip portion 36. Ridge 50 is shaped to be received by projection 40. This provides a nesting receipt and engagement of the outward facing side portion 53 (FIG. 7) of the inner rib 44 into the outwardly extending upper recess of projection 40 of tray 22, as shown in FIG. 6, with the ridge 52 shaped to receive ridge 38 so that dual-purpose portion 24 is releasably retained on lip portion 36.

Notably, the fact that dual-purpose portion 24 is sized to be used as a lid results in its being larger than the perimeter of inset portion 30. Thus, when being used as a base for package 20, dual-purpose portion 24 extends away from inset portion 30 to make package 20 substantially the same size at its top as at its bottom. Package 20 thus takes on more equal overall dimensions, and instead of only being displayed on its bottom, can also stably be displayed upright on one of the short sides 26 or side-lying on one of the long sides 28, providing the retailer with greater flexibility in displaying product.

Figure 8:
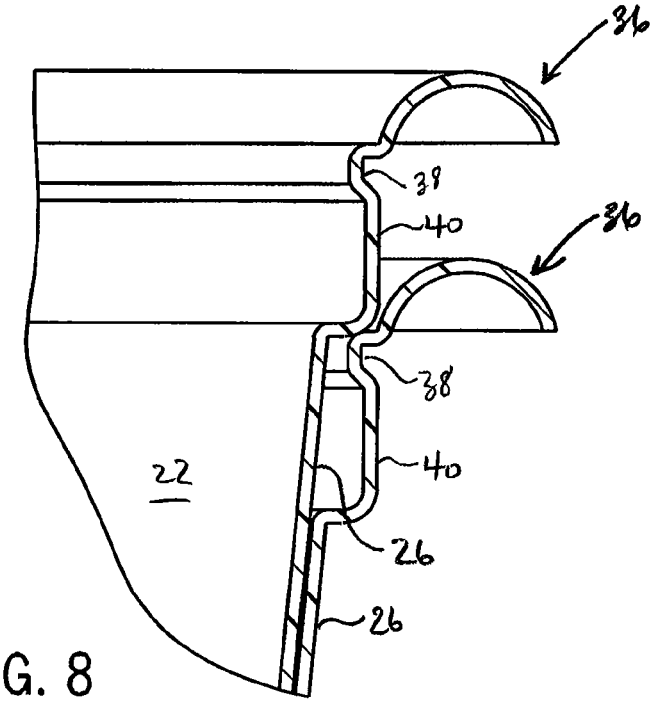
FIG. 8 is a perspective view of a plurality of trays, illustrating the stackability feature of this embodiment of the invention.

In use, one of a plurality of trays 22 is chosen from a stack of trays, as best seen in FIG. 8, at the packaging location. Fresh sausage is then packed in selected tray 22 and one of a plurality of dual-purpose portions 24 is connected to the inset portion 30 at the bottom of tray 22. The connection mechanism will be discussed below, but it can be seen from FIG. 1 that the entire package 20, including tray 22 and dual-purpose portion 24, is covered with wrap (W) after being filled. The wrap (W) could be any type of plastic film, but preferably is a film that allows a predetermined degree of oxygen exchange between the interior of tray 22 and the outside atmosphere in order to allow the sausage to take on the bright red appearance that consumers prefer, i.e. letting the meat "bloom".

After the packaging has taken place, the "case-ready" packages are transported to the retail location for display in the retailer's refrigerator case. As dictated by the retailer's available space and preferences, the packages can be displayed with bottom portion 34 down, or can be displayed on one of sides 26 or 28.

Once the consumer purchases package 20 and is ready to use the product within, he or she removes and discards the wrap (W), and accesses a quantity of product, e.g., as shown in FIG. 1, sausages. It is contemplated that the user will not use all of the sausages at any one time, but instead will store the remainder of the sausages in a refrigerator. The user then removes dual-purpose portion 24 from inset portion 30 of tray 22, places it on top of tray 22, and presses it into place over lip portion 36.

The embodiment described herein explains the best known mode of practicing the invention and will enable others skilled in the art to utilize the invention, but should not be considered limiting. For example, the contents of package 20 need not be sausage links, but instead the package could be sized to contain sausage patties or ground sausage or any meat. In fact any product that might best be packaged and displayed with a base portion, then stored with a top portion such that a dual-purpose portion as disclosed herein would be of value could be packed in the package of the present invention. Likewise, the wrap (W) need not be plastic, but could be any appropriate material, or package 20 could be secured with a band or series of bands or the like, or with no overwrapping whatsoever if the material packaged within tray 22 can be otherwise retained for packaging, shipping, and display at the retail location.

Further, the invention is not otherwise limited to the details of construction and arrangements of the components set forth herein, but is capable of other embodiments and of being practiced or carried out in various ways, and all such modifications and variations are within the scope of the claims set forth below.

I claim:

1. A package comprising:

a rigid tray having a base portion at a bottom of the tray, walls having lower portions, and an upper lip portion peripherally surrounding an opening at a top of the tray; and a dual purpose portion configured to connect to the rigid tray under the bottom of the tray defining a package base position of the duel purpose or over the top of the tray to cover the opening of the tray defining a package lid position of the dual purpose portion, the dual purpose portion having a planar surface and a rib extending generally orthogonally with respect to the planar surface, with the rib including a first side portion, a second side portion, a base segment, and an end segment with the first side portion facing a first direction inwardly toward the planar surface, the second side portion facing an opposite second direction outwardly away from the planar surface, the base segment connected to the planar surface, and the end segment extending away from and being wider than the base segment of the rib;

wherein the first side portion of the rib is configured to engage the lower portions of the walls of the tray when the dual purpose portion is in the package base position;

wherein the second portion is configured to engage the upper lip portion of the tray when the dual purpose portion is in the package lid position; and wherein when the dual purpose portion is in the package lid position, the rib extends downwardly toward the bottom of the tray and when the dual purpose portion is in the package base position, the dual purpose portion is inverted relative to the package lid position of the dual purpose portion with the rib extending upwardly away from the bottom of the tray when the dual purpose portion is in the package base position; wherein the closed bottom of the tray includes a floor and the tray has interconnected side with lower portions extending inwardly to define a detent adjacent the floor of the tray and wherein the inwardly facing portion of the rib of the dual purpose portion is received in the detent to hold the dual purpose portion under the bottom of the tray when the package is in the first configuration in which the dual purpose portion defines the package base.

2. The package of claim 1, wherein the base portion includes an offset portion and a floor portion, wherein the offset portion has a perimeter and the first portion of the rib is sized to press fit with respect to the perimeter to retain the dual purpose portion under the bottom of the tray.

3. The package of claim 1, wherein the second portion of the rib is sized to press fit with respect to the upper lip portion of the tray.

4. A package comprising:

a rigid tray having a closed bottom, an open top, and a wall extending about an interior of the tray with a lower recess adjacent the bottom and extending inwardly toward the interior of the tray and an upper recess adjacent the top and extending outwardly away from the interior of the tray;

a dual purpose portion having a planar surface and a rib extending away from the planar surface, the rib having an inwardly facing side portion facing inwardly toward the planar surface and an outwardly facing side portion facing outwardly away from the planar surface, wherein in a first configuration of the package, the dual purpose portion defines an inverted package base position with the rib facing upwardly away from the bottom of the tray and the inwardly facing side portion of the rib engaging and nesting into the lower recess of the tray; and wherein in a second configuration of the package, the dual purpose portion defines a package lid position with the rib facing downwardly toward the bottom of the tray and the outwardly facing side portion of the rib engaging and nesting into the upper recess of the tray; wherein the closed bottom of the tray includes a floor and the tray has interconnected sides with lower portions extending inwardly to define a detent adjacent the floor of the tray and wherein the inwardly facing portion of the rib of the dual purpose portion is received in the detent to hold the dual purpose portion under the bottom of the tray when the package is in the first configuration in which the dual purpose portion defines the package base.

5. The package of claim 4, wherein when the package is in the first configuration in which the dual purpose portion defines the package base, the dual purpose portion extends outwardly beyond the closed bottom of the tray.

6. The package of claim 4, wherein the open top of the tray includes a lip engaged by the outwardly facing portion of the rib of the dual purpose portion when the package is in the second configuration in which the dual purpose portion defines the package lid.

7. The package of claim 6, wherein when the package is in the second configuration in which the dual purpose portion defines the package lid, the dual purpose portion and the lip define an interconnected arrangement between corresponding ridges.

8. A method of using a package comprising the steps of: filling a rigid tray with product, wherein the tray has a closed bottom, a wall extending about an interior of the tray having a first recess extending, inwardly toward the interior of the tray, and an open top receiving the product during filling of the tray; wherein the closed bottom of the tray includes a floor and the tray has interconnected sides with lower portions extending inwardly to define a detent adjacent the floor of the tray and attaching a package base having a planar surface and a rib extending from the planar surface to the tray by pushing the package base from below toward the bottom of the tray and press fitting the rib into the first recess of the wall of the tray; wherein the inwardly facing portion of the rib of the dual purpose portion is received in the detent to hold the package base under the bottom of the tray;

wrapping the tray and base portion to seal in the product;

delivering the package to a retail location;

displaying the package for sale to a consumer; and converting the package base to a package lid, including, separating the package base from the tray;

inverting the package base to face an opposite direction;

pushing the inverted package base as the package lid from above toward the top of the tray engaging the tray to cover the open top of the tray with the package lid.

9. The method of claim 8, further comprising the step of storing the rigid trays in a stacked configuration.

10. The method of claim 8 wherein the wall of the tray includes a second recess extending outwardly away from the interior of the tray, the method further comprising:

press fitting the rib into the second recess of the wall of the tray while pushing the inverted package base as the package lid from above toward the top of the tray; and storing the remainder of the product until next use.

11. A package comprising:

a tray having a closed bottom, an open top, and interconnected sides extending about an interior of the tray and between the bottom and top of the tray, the sides defining an outer surface facing outwardly away from the interior of the tray and an inner surface facing inwardly into the interior of the tray; and a dual purpose portion configured as both a package base when the package is in a first configuration of the package with the dual purpose portion arranged below the bottom of the tray and a package lid when the package is in a second configuration of the package with the dual purpose portion arranged above the top of the tray, the dual purpose portion having, a planar portion with an outer surface and an opposing inner surface; and a rib extending generally orthogonally from the inner surface of planar portion of the dual purpose portion, the rib including a base segment and an end segment, wherein the base segment is narrower than and arranged closer to the planar portion than the end segment, the rib having an inwardly facing surface and an outwardly facing surface at opposing sides of the rib of the dual purpose portion, wherein the rib is configured so that when the package is in the first configuration with the dual purpose portion defining the package base, the inwardly facing surface of the rib engages the outer surface of the sides of the tray adjacent the bottom of the tray with the rib facing upwardly away from the bottom of the tray and the inner surface of the dual purpose portion facing upwardly toward the interior of the tray, wherein the closed bottom of the tray includes a floor and the tray has interconnected sides with lower portions extending inwardly to define a detent adjacent the floor of the tray and wherein the inwardly facing portion of the rib of the dual purpose portion is received in the detent to hold the dual purpose portion under the bottom of the tray when the package is in the first configuration in which the dual purpose portion defines the package base and when the package is in the second configuration with the dual purpose portion defining the package lid, the dual purpose portion is inverted with respect to the dual purpose portion defining the package base such that when the dual purpose portion defines the package lid, the outwardly facing surface of the rib engages the inner surface of the sides of the tray adjacent the top of the tray with the rib facing downwardly toward the bottom of the tray and the inner surface of the dual purpose portion facing downwardly toward the interior of the tray.

* * * * *